US005095588A

United States Patent [19]

Hergeth

[11] Patent Number: 5,095,588

[45] Date of Patent: Mar. 17, 1992

[54] HIGH SPEED FIBER OPENING MACHINE HAVING A SUCTION CHAMBER WITH A BICONCAVE SPACE

[76] Inventor: Hubert Hergeth, Kockerellstrasse 3, 5100 Aachen, Fed. Rep. of Germany

[21] Appl. No.: 687,073

[22] Filed: Apr. 17, 1991

Related U.S. Application Data

[63] Continuation-in-part of Ser. No. 508,908, Apr. 12, 1990, abandoned.

[30] Foreign Application Priority Data

Apr. 12, 1989 [DE] Fed. Rep. of Germany ..... 3911897

[51] Int. Cl.[5] ..... D01G 9/18

[52] U.S. Cl. ..... 19/205

[58] Field of Search ..... 19/200, 205, 66 R, 80 R, 19/50, 58, 106 R, 203

[56] References Cited

U.S. PATENT DOCUMENTS

| | | | |
|---|---|---|---|
| 1,777,059 | 9/1930 | Wallace | 19/58 |
| 2,489,827 | 11/1949 | Smith | 19/58 |
| 2,731,674 | 1/1956 | Wallace | 19/58 |
| 2,876,500 | 3/1959 | Buresh et al. | 19/205 |
| 2,973,559 | 3/1961 | O'Neal | 19/50 |
| 3,046,612 | 7/1962 | Kyame et al. | 19/203 |
| 3,984,896 | 10/1976 | Hicks | 19/200 X |
| 4,035,871 | 7/1977 | Stahlecker | 19/200 |
| 4,507,827 | 4/1985 | Staehli | 19/200 |

*Primary Examiner*—Werner H. Schroeder
*Assistant Examiner*—John J. Calvert
*Attorney, Agent, or Firm*—Michael J. Striker

[57] ABSTRACT

The fiber opening machine has an opening drum with adjacent trough, which receives fibers from a feeding device with feeding rollers. The fiber opening machine has a suction chamber for generating an air current to remove open fibers from the opening drum. The suction chamber is defined by the output side of the opening drum and an opposing suction chamber wall which is shaped to form a biconcave space through which a current of air is passed to remove the fibers from the opening drum so that fibers are removed from the drum without nep formation at rotational speeds which are higher than those attainable without the biconcave space.

2 Claims, 1 Drawing Sheet

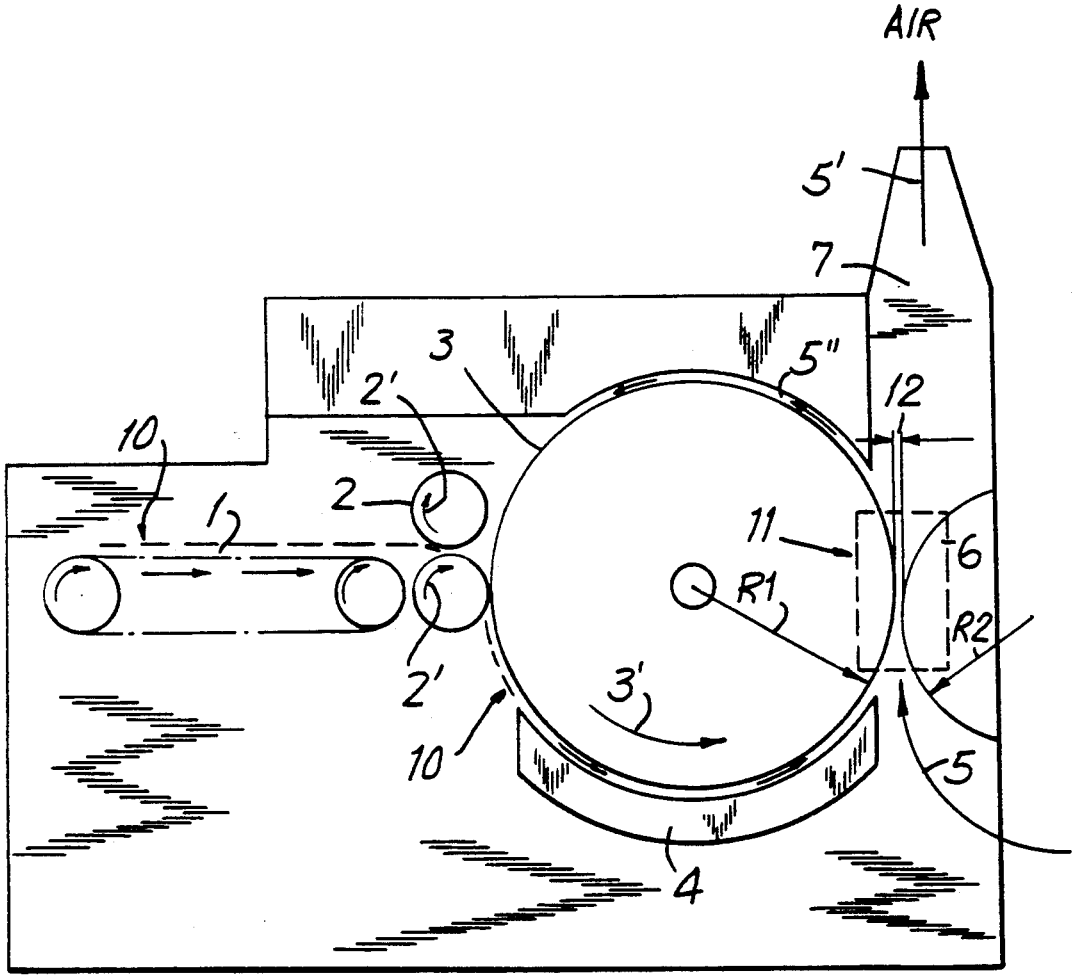
AIR
5'
7
3
5"
2'
12
10
2
1
11
6
R1
R2
2'
3'
10
5
4

HIGH SPEED FIBER OPENING MACHINE HAVING A SUCTION CHAMBER WITH A BICONCAVE SPACE

This application is a continuation-in-part of application Ser. No. 508,908, filed Apr. 12, 1990.

BACKGROUND OF THE INVENTION

The invention relates to opening and cleaning machines for textile fibers.

A fiber opening machine is known consisting of a feeding device, a drawing-in system, at least one opening drum trimmed with saw teeth, possibly cleaning elements, and a removal device. This removal device can be a brushing roller, a sieve drum, or more conventionally a suction hood. These suction hoods have been known for generations and consist either of an extension, assigned to the opening drum, in which the fibers are centrifuged, or of a metal sheet that is arranged near the opening drum. This metal sheet is intended to increase the air speed between opening drum and metal sheet such that the fibers are drawn off of the drum set by an air current which is faster than the circumferential speed of the drum.

The circumferential speeds of the drum and the drum widths have recently been greatly increased, so that the removal of the fibers from the sets has become more difficult. European Patent Application No. 0,108,229 proposes a special embodiment of the drum screening after the point of detachment. Because of its complicated embodiment, this proposal has not been widely applied.

SUMMARY OF THE INVENTION

It is the object of the invention to employ a simple device to improve the removal of the fibers from the drum in an effective fashion, especially at high rotational speeds.

According to the invention the opening drum and a suction chamber wall form a biconcave space between themselves. The suction chamber wall opposite the drum surface at the fiber removal side is provided with a camber, so that a biconcave space arises between drum and wall in the vicinity of a point of closest spacing or minimum separation between them. In the vicinity of the drum, the radius of the wall is smaller than the radius of the drum. The air flow, which surrounds the drum and envelopes the fibers at the spikes of the set, skips over the smaller radius, and the fibers are lifted cleanly from the set even at high speeds.

BRIEF DESCRIPTION OF THE DRAWINGS

FIG. 1 is a cross sectional view of an opening machine having a suction device for fiber removal with a biconcave space according to the invention.

DESCRIPTION OF THE PREFERRED EMBODIMENTS

The fibers are led to the feeding rollers 2 by the feeding device 1 and gripped by the opening drum 3. The fibers are led past the trough 4 and removed from the drum by an air current. The air current 5 passes the biconcave space between the drum 3 and the lifting nose 6. At the opposite end of the biconcave space, the fibers leave the machine through a suction hood 7.

In more detail, the feed rollers 2 are fluted or wire wound and spaced a distance of about 1 mm from each other. The spacing of the feed roller 2 to the largest diameter of the opening drum is about a tenth of a millimeter. The fibers 10 are opened by pins or sawtooth wire on the surface of the drum 3. The diameter of the drum is normally about 400 mm with a speed of 800 to 3500 rounds per minute. But also small drums of 100 mm diameter are possible. The fibers 10 leave the machine at the top of the suction chamber 7 being conveyed by an air stream 5' of about 3000 to 6000 $m^3$/hour. The air is pulled from outside the machine through a gap formed by the biconcave surfaces. The biconcave space or zone 11, shown with dashed lines in the drawing, is the region in which the surface of the opening roller 3 and the surface of the suction chamber wall 6 face each other. There are two air streams—one is the air being pulled from the outside at the end of the machine and the other is the air layer 5'' surrounding and rotating with the opening drum 3. The air will follow the smaller radius in the biconcave space. As the air passes the surface of the suction chamber it takes with it the fibers 10 carried on the surface of the opening drum 3. In this way the surface is better cleaned of the fibers. Therefore, the fibers 10 do not travel several times around the opening drum 3 and entanglements of fibers called "neps" caused by air turbulence at the opening points to the feed rollers and elsewhere are avoided.

It will be understood that each of the elements described above, or two or more together, may also find a useful application in other types of structures differing from the types described above.

While the invention has been illustrated and described as embodied in a high speed fiber opening machine having a suction chamber with a biconcave space, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. An opening or cleaning machine for fiber material, comprising an opening drum with a predetermined radius for opening fibers of a fiber material; and a suction chamber for generating an air current to remove the opened fibers from the opening roller, said suction chamber having a suction chamber wall which is located substantially close to said opening drum and forms a biconcave space together with the opening roller, said wall of said chamber being formed as a camber with a radius which is smaller than the predetermined radius of said drum and said suction chamber wall being spaced from said drum by a distance substantially between 2 and 20 mm at a point of smallest distance between said wall of said suction chamber and said opening drum.

2. An opening or cleaning machine for fiber material, comprising an opening drum with a predetermined radius for opening fibers of a fiber material; and a suction chamber for generating an air current to remove the opened fibers from the opening roller, said suction chamber having a suction chamber wall which is located substantially close to said opening drum and forms a biconcave space together with the opening roller, said wall of said chamber being formed as a camber with a radius which is smaller than the predetermined radius of said drum and said biconcave space extending up to 80 mm below and above a point of minimum separation between said wall of said suction chamber and said opening drum.

* * * * *